United States Patent [19]

Igarashi

[11] Patent Number: 4,716,387

[45] Date of Patent: Dec. 29, 1987

[54] WAVEGUIDE-MICROSTRIP LINE CONVERTER

[75] Inventor: Sadao Igarashi, Soma, Japan

[73] Assignee: Alps Electric Co., Ltd., Japan

[21] Appl. No.: 911,400

[22] Filed: Sep. 25, 1986

[30] Foreign Application Priority Data

Sep. 30, 1985 [JP] Japan ..... 60-150551

[51] Int. Cl.[4] ..... H01P 5/107

[52] U.S. Cl. ..... 333/26; 333/33; 333/208; 333/239

[58] Field of Search ..... 333/21 R, 26, 33, 236, 333/238, 246, 239, 248, 99 R

[56] References Cited

U.S. PATENT DOCUMENTS 3,265,995 8/1966 Hamasaki ..... 333/26 X
3,768,048 10/1973 Jones, Jr. et al. ..... 333/238
4,280,112 7/1981 Eisenhart .
4,349,790 9/1982 Landry .

FOREIGN PATENT DOCUMENTS 103803 6/1985 Japan ..... 333/26

*Primary Examiner*—Paul Gensler
*Attorney, Agent, or Firm*—Guy W. Shoup

[57] ABSTRACT

A waveguide-microstrip line coverter to be used in combination with a waveguide, for mode conversion in transmitting a signal from the waveguide to a microstrip line. A probe for receiving a signal transmitted through the waveguide is formed by forming a conductive layer over the inner surface of a hole formed in a cuboidal dielectric body and is connected directly to the microstrip line to avoid needless induction of inductance. Since the hole can be formed accurately in size and position in the cuboidal dielectric body and the probe is formed accurately in size and position and is highly resistant to vibration.

10 Claims, 5 Drawing Figures

WAVEGUIDE-MICROSTRIP LINE CONVERTER

BACKGROUND OF THE INVENTION

1. Field of the Invention

The present invention relates to a waveguide-microstrip line converter for transmitting signals transmitted through a waveguide packed with a dielectric to a microstrip line without signal transmission loss.

2. Description of the Prior Art

The dominant mode of a general rectangular waveguide is TE mode while the mode of a microstrip line is TEM mode. Therefore, the rectangular waveguide and the microstrip line need to be interconnected by a converter with a sufficiently small signal transmission loss.

In FIG. 5, illustrating a conventional waveguide-microstrip line converter, there are shown a short-circuit waveguide 21, a probe 22, a coaxial center conductor 23, a coaxial dielectric body 24, a microstrip line 25, a connecting member 26, a mount 27 and a MIC substrate 28. The signal transmitted through the short-circuit waveguide 21 is received by the probe 22. The probe 22 is attached to the free end of the center conductor 23. The center conductor 23 extends through a hole formed in the wall of the short-circuit waveguide 21 and the other end of the center conductor 23 is connected to the microstrip line 25 with a connecting member 26. A dielectric element 24 is provided on the center conductor 23 to insulate the center conductor 23 from the short-circuit waveguide 21 and to fix the center conductor 23 to the short-circuit waveguide 21. Thus the signal transmitted through the short-circuit waveguide 21 is received by the probe 22 and the waveguide mode is converted properly into the microstrip line mode in transmitting the signal through the center conductor 23 and the connecting member 26 to the microstrip line 25. The diameter and length of the probe 22, the length of a portion including the center conductor 23 and the probe 22 projecting inside the short-circuit waveguide 21, and the location of the probe 22, namely, the distance between the end of the short-circuit waveguide 21 and the center of the probe 22 and the distance between the side wall of the short-circuit waveguide 21 and the center of the probe 22, are decided properly for best impedance matching. The microstrip line 25 is formed by printing a conductor on the MIC substrate 28 attached to the integral mount 27 of the short-circuit waveguide 21.

Since the probe 22 is inserted through the hole formed in the wall of the short-circuit waveguide 21 into the short-circuit waveguide 21 so as to project from the inner surface of the short-circuit waveguide 21, it is difficult to adjust the length of projection of the probe 22 inside the short-circuit waveguide 21 properly in attaching the probe 22 to the short-circuit waveguide 21, and hence the length is often different from a predetermined correct length. Since the probe 22 is fixed at a portion corresponding to the hole formed in the short-circuit waveguide 21, it is difficult to attach the probe 22 to the short-circuit waveguide 21 so as to extend at right angles to the wall surface of the short-circuit waveguide 21. Consequently, the probe 22 is liable to be located inaccurately relative to the end and side wall of the short-circuit waveguide 21. Furthermore, in soldering the connecting member 26 to the center conductor 23 and the microstrip line 25, it is difficult to solder the connecting member 26 to the center conductor 23 and the microstrip line 25 at correct position with an appropriate amount of solder. All these difficulties entail a problem that impedance matching is deteriorated in converting the waveguide mode into the microstrip line mode. Since the center conductor 23 and the microstrip line 25 are interconnected by the connecting member 26, the electromagnetic radiation from the connecting member 26 causes signal transmission loss and large signal transmission loss makes broad-band transmission impossible. Moreover, since the probe 22 is secured at a portion corresponding to the hole formed in the wall of the short-circuit waveguide 21 to the short-circuit waveguide 21, the probe 22 is unstable when subjected to vibrations, and hence the location of the probe 22 is liable to change with time.

SUMMARY OF THE INVENTION

Accordingly, in view of the problems of the conventional waveguide-microstrip line converter, it is an object of the present invention to provide a waveguide-microstrip line converter having a probe formed by forming a conductive layer over the inner surface of a hole formed in a dielectric body to obviate the deterioration of impedance matching attributable to incorrect location of the probe, and connected directly to a microstrip line to reduce signal transmission loss.

The object of the present invention is achieved by a waveguide-microstrip line converter comprising a cuboidal dielectric body having a hole formed in one surface thereof, a probe formed by forming a conductive layer over the inner surface of the hole formed in the cuboidal dielectric body so as to be connected to a microstrip line, and a conductive layer formed over the surface of the cuboidal dielectric body excluding at least one surface of the cuboidal dielectric body to be brought into contact with a waveguide, an area surrounding the probe, and an area to be disposed opposite the microstrip line. The waveguide-microstrip line converter is connected to a waveguide with the surface thereof not coated with any conductive layer in contact with the waveguide for mode conversion.

Since the probe is formed by forming a conductive layer over the inner surface of the hole formed in the cuboidal dielectric body in stead of placing an individual probe in a short-circuit waveguide as in the prior art, the probe can be located correctly in position. Since the probe is connected directly to the microstrip line, there is no possibility of electromagnetic radiation, and hence signal transmission loss is very small. Moreover, since the probe is secured entirely by the dielectric body, the waveguide-microstrip line converter is resistant to vibration and the performance thereof changes scarcely with time.

The above and other objects, features and advantages of the waveguide-microstrip line converter according to the present invention will become more apparent from the following description of preferred embodiments thereof taken in conjunction with the accompanying drawings.

DESCRIPTION OF THE PREFERRED EMBODIMENTS

Figure 1:
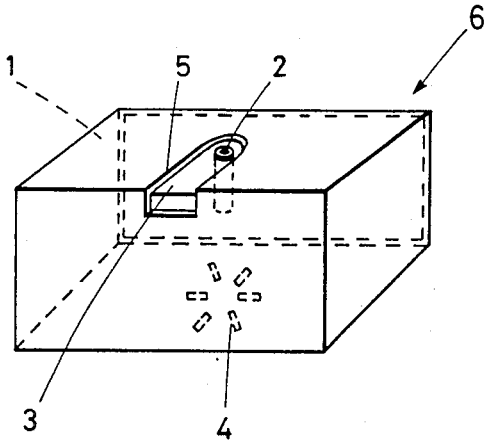
FIG. 1 is a perspective view of a waveguide-microstrip line converter, in a first embodiment, according to the present invention.
Figure 2:
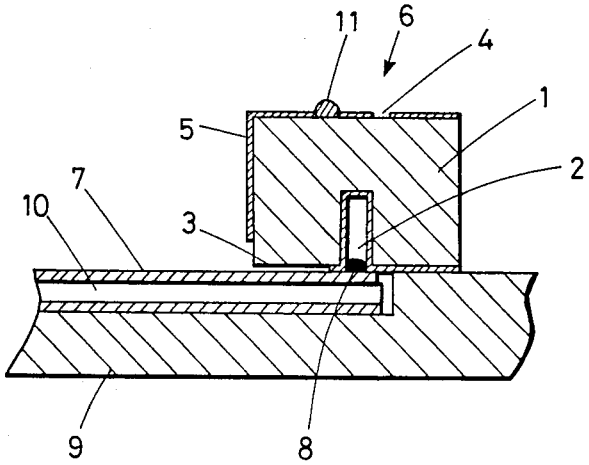
FIG. 2 is a sectional view of the waveguide-microstrip line converter of FIG. 1, in which the waveguide-microstrip line converter is connected to a microstrip line.

Referring to FIG. 1, a cuboidal dielectric body 1 is provided with a hole in one surface thereof and a conductive layer is formed over the inner surface of the hole to form a probe 2. A conductive layer 5 is formed over the entire surface of the dielectric body 1 excluding a surface to be placed in contact with a waveguide, an exposed area 3 surrounding the probe 2 and radial slits 4 formed in a surface in the rear of block 1 opposite the exposed area 3, to form a short-circuit waveguide packed with a dielectric. The short-circuit waveguide and the probe 2 constitute a waveguide-microstrip line converter 6. The exposed area 3 has the shape of a band which extends at right angles to the surface connected to a waveguide and has a width greater than that of a microstrip line which will be described later. The waveguide-microstrip line converter 6 thus constituted is connected fixedly to a waveguide with the probe 2 connected directly to a microstrip line 7 by solder 8 as illustrated in FIG. 2. The microstrip line 7 is formed on a MIC substrate 10 fixed to a mount 9. The creamy solder 8 is solidified by heating the mount 9.

The mode of the electromagnetic wave applied by the waveguide to the waveguide-microstrip line converter 6 is converted by the probe 2, and then the electromagnetic wave is given to the microstrip line 7. Since the exposed area 3 is formed in a band extending in parallel to the direction of input and output of the electromagnetic wave and substantially in parallel to the direction of surface current carried by the conductive layer 5 formed over the surface of the dielectric body 1, the exposed area 3 does not cause signal transmission loss. Since the hole can be formed in the dielectric body 1 with sufficient accuracy in size and position, the probe 2 has accurate size, and hence the variation of impedance matching is reduced. Furthermore, the impedance matching can be adjusted by properly filling up the slits 4 with solder 11. The slits 4 are arranged radially and substantially in parallel to the surface current to avoid signal transmission loss. Since the probe 2 is connected directly to the microstrip line 7 and is surrounded by the conductive layer 5, signal transmission loss due to electromagnetic radiation is obviated.

Figure 3:
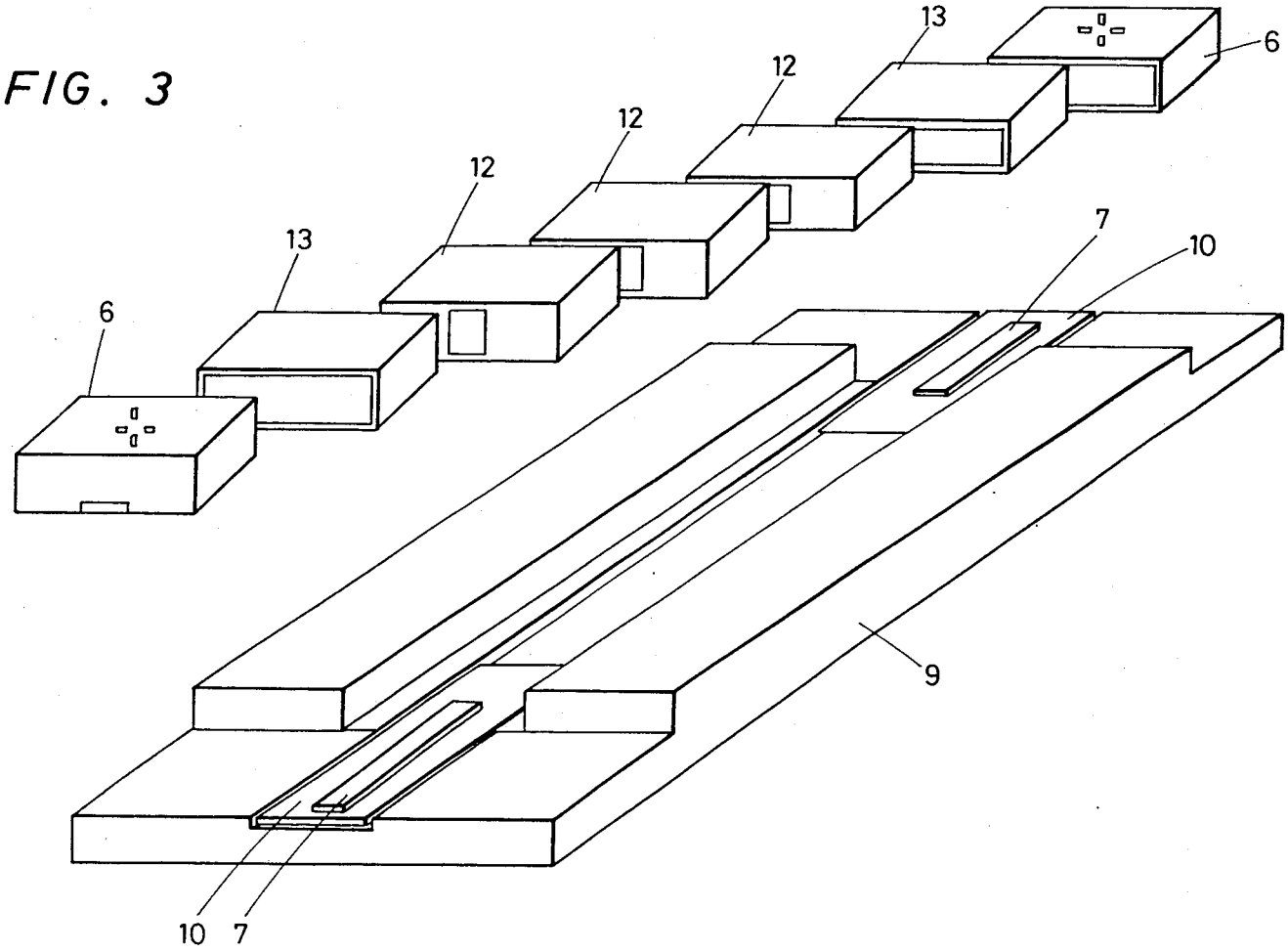
FIG. 3 is an exploded perspective view of an exemplary band-pass filter incorporating the waveguide-microstrip line converter of FIG. 1.

Referring to FIG. 3, a band-pass filter incorporating the waveguide-microstrip line converters 6 of the present invention has a mount 9 fixedly provided at the opposite ends thereof with MIC substrates 10 respectively having microstrip lines 7. A plurality of waveguide resonators 12 packed with a dielectric are connected and a pair of waveguides 13 packed with a dielectric are disposed at the opposite ends of the array of the waveguide resonators 13, respectively. A pair of the waveguide-microstrip line converters 6 are disposed on the outer side of the waveguides 13 and are connected to the microstrip lines 7, respectively.

Figure 4:
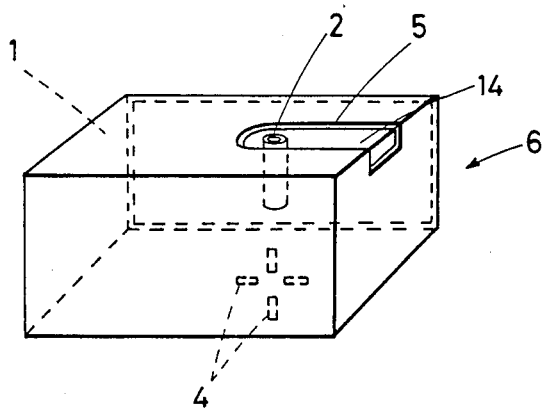
FIG. 4 is a perspective view of a waveguide-microstrip line converter, in a second embodiment, according to the present invention.
Figure 5:
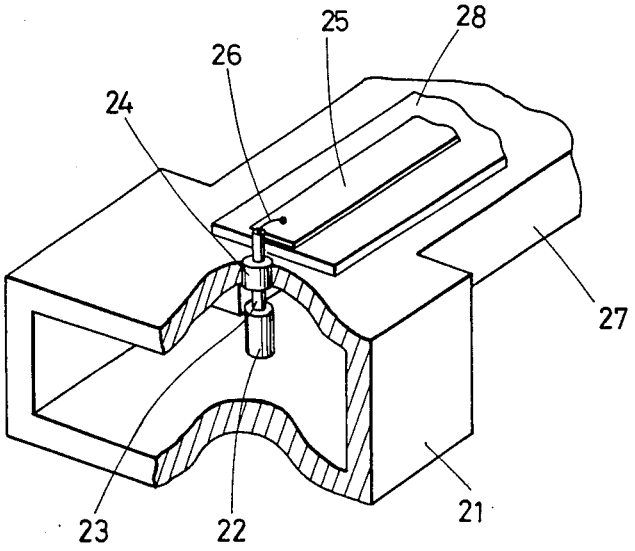
FIG. 5 PRIOR ART
FIG. 5 is a perspective view, partly broken, of a conventional waveguide-microstrip line converter.

Referring to FIG. 4 illustrating a second embodiment of the present invention, the second embodiment is different from the first embodiment shown in FIG. 1 in that an exposed area 14 surrounding a probe 2 is formed in the form of a band extending at right angles to the direction of input and output of the electromagnetic field of the waveguide. This exposed area 14, similarly to the exposed area 3 of the first embodiment, extends in the radial direction of the probe 2 and substantially in parallel to the direction of the surface current, and hence the exposed area 14 does not cause signal transmission loss.

As apparent from the foregoing description, according to the present invention, a probe can be formed accurately in size and position in a dielectric body because the probe is formed by forming a conductive layer over the inner surface of a hole formed in the dielectric body and the hole can be formed accurately in size and position. Furthermore, since the probe is connected directly to a microstrip line, needless inductance is not induced in the circuit and the impedance matching is facilitated. Still further, since the probe is connected directly to a microstrip line and is surrounded by a conductive layer, electromagnetic radiation is controlled and signal transmission loss is very small. Moreover, since the probe is secured entirely by the dielectric body, the probe is highly resistant to vibration and the variation of the probe in performance attributable to vibration is very samll.

Although the invention has been described in its preferred forms with a certain degree of particularity, it is to be understood by those skilled in the art that many changes and variations are possible in the invention without departing from the scope and spirit thereof.

What is claimed is:

1. A waveguide-microstrip line converter to be connected to a waveguide for mode conversion in transmitting a signal from the waveguide to a microstrip line, which comprises: a cuboidal dielectric body having a hole formed in one surface thereof; a probe formed by forming a conductive layer over the inner surface of the hole formed in the cuboidal dielectric body so as to be connected to a microstrip line; and a conductive layer formed over the surface of the cuboidal body excluding at least one surface of the cuboidal dielectric body to be brought into contact with the waveguide, an area surrounding the probe, and an area to be disposed opposite the microstrip line.

2. A waveguide-microstrip line converter according to claim 1, wherein the area to be disposed opposite the microstrip line is formed in the shape of a band extending at right angles to the surface to be placed in contact with a waveguide and having a width greater than that of the corresponding microstrip line.

3. A waveguide-microstrip line converter according to claim 2, wherein the probe is soldered to the corresponding microstrip line.

4. A waveguide-microstrip line converter according to claim 2, wherein a plurality of slits are formed for adjusting the impedance matching in a radial arrangement in one surface of the cuboidal dielectric body opposite the surface provided with the hole for forming the probe.

5. A waveguide-microstrip line converter according to claim 1, wherein the area to be disposed opposite the microstrip line is formed in the shape of a band extending at right angles to the output-input direction of the electromagnetic field of the waveguide.

6. A waveguide-microstrip line converter according to claim 5, wherein the probe is soldered to the corresponding microstrip line.

7. A waveguide-microstrip line converter according to claim 5, wherein a plurality of slits are formed for adjusting the impedance matching in a radial arrangement in one surface of the cuboidal dielectric body opposite the surface provided with the hole for forming the probe.

8. A waveguide-microstrip line converter according to claim 1, wherein the probe is soldered to the corresponding microstrip line.

9. A waveguide-microstrip line converter according to claim 8, wherein a plurality of slits are formed for adjusting the impedance matching in a radial arrangement in one surface of the cuboidal dielectric body opposite the surface provided with the hole for forming the probe.

10. A waveguide-microstrip line converter according to claim 1, wherein a plurality of slits are formed for adjusting the impedance matching in a radial arrangement in one surface of the cuboidal dielectric body opposite the surface provided with the hole for forming the probe.

* * * * *